US011549281B2

(12) United States Patent
Laibe

(10) Patent No.: US 11,549,281 B2
(45) Date of Patent: Jan. 10, 2023

(54) DOOR PLATE SYSTEM, KIT, AND METHOD

(71) Applicant: Nick Laibe, Republic, OH (US)

(72) Inventor: Nick Laibe, Republic, OH (US)

( * ) Notice: Subject to any disclaimer, the term of this patent is extended or adjusted under 35 U.S.C. 154(b) by 300 days.

(21) Appl. No.: 16/897,449

(22) Filed: Jun. 10, 2020

(65) Prior Publication Data

US 2020/0392755 A1 Dec. 17, 2020

Related U.S. Application Data

(60) Provisional application No. 62/859,891, filed on Jun. 11, 2019.

(51) Int. Cl.

| | |
|---|---|
| ***E05B 17/20*** | (2006.01) |
| ***E05B 9/00*** | (2006.01) |
| ***E06B 5/11*** | (2006.01) |

(52) U.S. Cl.

CPC ..... *E05B 17/2003* (2013.01); *E05B 9/002* (2013.01); *E05B 17/2084* (2013.01); *E06B 5/113* (2013.01); *E05Y 2900/132* (2013.01)

(58) Field of Classification Search

CPC ... E05B 9/002; E05B 9/02; E05B 9/08; E05B 17/2003; E05B 17/2084; E06B 3/88; E06B 5/113; E05Y 2900/132

See application file for complete search history.

(56) References Cited

U.S. PATENT DOCUMENTS

| | | | | |
|---|---|---|---|---|
| 3,666,309 | A * | 5/1972 | Zarzycki | E05B 9/00 292/337 |
| 3,673,605 | A * | 6/1972 | Allenbaugh | E05B 17/2084 70/451 |
| 4,139,999 | A * | 2/1979 | Allenbaugh | E05B 17/2084 70/448 |
| 4,505,504 | A * | 3/1985 | Matzkin | E05B 9/00 292/337 |
| 5,040,393 | A * | 8/1991 | Rossebo | E05B 63/08 70/451 |
| 6,581,333 | B2 * | 6/2003 | Kimball | E05B 9/02 49/504 |
| 7,086,259 | B2 | 8/2006 | Almoznino | |
| 7,467,818 | B2 * | 12/2008 | Young | E05B 63/10 49/504 |
| 8,381,558 | B2 * | 2/2013 | Alef | E05B 65/0017 70/141 |
| 9,127,505 | B2 * | 9/2015 | Olberding | E05B 9/002 |
| 9,487,975 | B2 | 11/2016 | Daniels et al. | |
| 9,523,224 | B2 * | 12/2016 | Daniels | E05B 9/002 |

(Continued)

*Primary Examiner* — Christopher J Boswell

(74) *Attorney, Agent, or Firm* — Jacob M. Ward; Ward Law Office LLC

(57) ABSTRACT

A door plate has a main body with a front side, a rear side, a top side, a bottom side, a first adjacent side, and a second adjacent side. The main body includes a handle aperture and fastener apertures. The handle aperture is configured to receive a door handle of the door. The handle aperture is formed through the main body from the front side to the rear side of the main body. Each of the plurality of fasteners is formed through the main body from the front side to the rear side. The main body has a depth defined by a maximum distance between the front side and the rear side of the main body at the second adjacent side of the main body. The depth of the main body militates against a prying of the door with a crowbar where the main body is installed on the door.

6 Claims, 6 Drawing Sheets

(56) References Cited

U.S. PATENT DOCUMENTS

| | | | | |
|---|---|---|---|---|
| 10,876,351 | B2 * | 12/2020 | Fields, I | E05B 17/2084 |
| 2007/0210589 | A1 * | 9/2007 | vanGasselt | E05B 9/002 292/336.3 |

* cited by examiner

DOOR PLATE SYSTEM, KIT, AND METHOD

CROSS-REFERENCE TO RELATED APPLICATIONS

This application claims the benefit of U.S. Provisional Application No. 62/859,891, filed on Jun. 11, 2019. The entire disclosure of the above application is hereby incorporated herein by reference.

FIELD

The present disclosure relates to doors and, more particularly, to a security device for a door.

BACKGROUND

Security has always been a concern for residential and business premises. Exterior doors, especially, must be sufficiently secured to prevent being accessed by skilled burglars. Numerous security systems have been devised in accordance with the prior art. However, even with these improvements, burglars have still been found to circumvent security and access exterior doors.

Some have tried to circumvent security shortcomings by providing pick-resistant locks that make picking the lock even by a skilled burglar difficult. For example, U.S. Pat. No. 7,086,259 to Almoznino discloses a lock with an anti-picking cylinder. However, undesirably, these locks may still be circumvented. For instance, the door may still be accessed by using a crowbar to pry open the door. Using this method, entry may be gained without disturbing or overcoming the lock itself.

Another example of circumventing security shortcomings is by providing additional entrance barriers. For example, U.S. Pat. No. 9,487,975 to Daniels et al. discloses a system including a barrier, a first lock assembly, a second lock assembly, and an override mechanism. Undesirably, these systems may be overly complex and costly.

There is a continuing need for a system, kit, and method that militates against a forceful entry. Desirably, the system, kit, and method militates against prying open the door by using a crowbar.

SUMMARY

In concordance with the instant disclosure, a system, kit, and method militates against a forceful entry, and which militates against prying open the door by using a crowbar, has been surprisingly discovered.

This disclosure deals primarily with providing additional security to exterior doors. However, it should be appreciated that a skilled artisan may apply the present disclosure to other types of doors, such as interior doors, as desired.

In one embodiment, a door plate for a door has a main body with a front side, a rear side, a top side, a bottom side, a first adjacent side, and a second adjacent side. The main body includes a handle aperture and a plurality of fastener apertures. The handle aperture is configured to receive a door handle of the door. The handle aperture is formed through the main body from the front side to the rear side of the main body. Each of the plurality of fasteners is configured to receive a fastener. Each of the plurality of fasteners is formed through the main body from the front side to the rear side. The main body has a depth that is at least 0.375 inches, and the depth is defined by a maximum distance between the front side and the rear side of the main body at the second adjacent side of the main body. The depth of the main body militates against a prying of the door with a crowbar where the main body is installed on the door.

In another embodiment, a door protection system includes a door, a door plate, and a plurality of fasteners. The door has a door handle. The door plate has a main body with a front side, a rear side, a top side, a bottom side, a first adjacent side, and a second adjacent side. The main body includes a handle aperture and a plurality of fastener apertures. The handle aperture surrounds the door handle of the door. The handle aperture is formed through the main body from the front side to the rear side of the main body. Each of the plurality of fasteners is formed through the main body from the front side to the rear side. The main body has a depth that is at least 0.375 inches, and the depth is defined by a maximum distance between the front side and the rear side of the main body at the second adjacent side of the main body. The depth of the main body militates against a prying of the door with a crowbar where the main body is installed on the door. Each of the plurality of fasteners is disposed through one of the plurality of fastener apertures and the door, thereby affixing the door plate to the door.

In another embodiment, a method for installing the door plate includes the step of the door with the door handle. Then, a step of providing the door plate. Next, a step of providing the plurality of fasteners. Then, a step of disposing the door plate on the door. The handle aperture surrounds the handle of the door. Next, a step of disposing each of the plurality of fasteners through one of the plurality of fastener apertures and the door, thereby securing the door plate to the door.

In an exemplary embodiment, a door plate having a main body. The main body is adapted to be secured to a door, and to militate against a forcible breaking and entering into a building. More specifically, the main body of the door plate may mitigate a breaking of a locking mechanism of the door, by militating against an insertion of a crowbar between the door and a doorjamb.

It should be understood that the door plate may be formed from any suitable material, including metals. In a non-limiting example, the door plate may be formed from a metal such as a steel. The metal material chose for the door plate may also be selected for weather-resistance. The door plate may be formed by any suitable process such as a stamping process using a hydraulic press. Other suitable materials and processes for forming the door plate may also be chosen by one skilled in the art, as desired.

The door plate has a thickness that renders it resistant to manual bending or damage, for example, with a crowbar. For example, the door plate may have a maximum thickness of about 0.63 inches and a minimum thickness of about 0.38 inches. In a further non-limiting example, the door plate may be substantially rectangular in shape. However, other suitable dimensions and shapes may be chosen by one skilled in the art, as desired.

In particular embodiments, the main body may have at least one aperture. For example, the at least one aperture may be two or four apertures. Each aperture may be adapted to receive a fastener. For example, the fasteners may include mechanical fasteners such as bolts, screws, rivets, pins, and the like. Further structure such as nuts and washers may also be employed with the fasteners. Advantageously, the fasteners may permit for a robust attachment of the main body to the door and militate against a removal or movement of the main body away from the door by a crowbar during an attempted breaking and entering.

In further embodiments, the fastener may have a head that is adapted to turn the fastener or abut a surface surrounding the aperture. In a non-limiting example, the main body may have a countersink or other recess disposed adjacent the aperture that is adapted to receive the head of the fastener. Advantageously, where the head of the fastener is disposed within the recess, the recess militates against a prying of the fastener head from the door plate. This positioning of the head of the fastener within the recess thereby further militates against removal of the door plate during the attempted breaking and entering.

In a particular embodiment, the main body of the door plate may have an opening that is adapted to receive a door handle. In a non-limiting example, the opening may be disposed between the four apertures, which are in turn adapted to receive the fasteners. It should be appreciated that, where the main body of the door plate is secured adjacent to the door handle, the door plate permits a normal operation of the door handle while creating a barrier to the space between the door and the door jamb where the crowbar might otherwise be inserted by a thief.

In a further embodiment, the door plate may be adapted to be affixed to the front of the door, where the door is opened outwardly relative to the building. For example, the door plate in this embodiment may have an overhang that is adapted to protect and receive a portion of the door jamb where the door is in a closed position. For example, the overhang may be thinner than the main body.

Alternatively, the overhang may have a same thickness as a remainder of the main body and may instead be formed by a bending of the main body of the door plate. In this example, the bent portion of the main body may be adapted to receive the portion of the door jamb where the door is in the closed position.

In a most particular embodiment, the door plate with an overhang may be about eight inches (8") wide, about twelve inches (12") long and about three-fifth inches (0.6") thick. In another example, the overhang may be approximately two inches (2") wide and about twelve inches (12") long. In a further example, the door plate at the overhang may be about two-fifth inches (0.4") thick. In another example, the opening of the door plate may have a diameter of approximately two-and-one-fourth inches (2.25") and the apertures may each be about one-half inches (0.5") in diameter. Other suitable dimensions may also be used, as desired.

In a further embodiment, the door plate may be adapted to be secured to the front of the door, where the door opens inwardly into the building. In a most particular example, the door plate may have two fastening apertures, and the opening is adapted to receive the door handle. In further example, the opening may be disposed between the two fastening apertures.

In a most particular example, the door plate may be about sixteen inches (16") long, and about four-and-one-half inches (4.5") wide and about one-half inches (0.5") thick. In another example, the opening of the door plate may have a diameter of about three-and-six-tenths inches (3.6") and the apertures may be about one-half inch (0.5") in diameter. The recess may be approximately one-quarter inches (0.25") in depth. Other suitable dimensions may also be used by a skilled artisan within the scope of the present disclosure.

In operation, a method of mounting a door plate to the door may include a first step of providing the door plate, and a second step of providing the door. In a third step, the door handle of the door may be inserted into the opening of the door plate. It should be appreciated that the door may be supplied with the door plate affixed to the door with adhesive or adhesive tape, which allows for easy installation. There may also be a temporary, installation-only shim disposed between the door jamb and the edge of the door plate that creates a gap between the door plate and the door jamb so that the plate has sufficient clearance with the door jam in operation. Once the door handle is disposed through the opening, in a fourth step, the door plate may be secured to the door. For example, fasteners may be inserted into the apertures in the door plate and then through apertures in the door to be secured to the opposing side of the door. In a fifth step, once secured to the door adjacent the door handle, the door plate militates against the breaking entering into a building.

For example, the door plate may prevent an insertion of the crowbar in between the door and the door jamb. It should be appreciated that without the crowbar between the door and the door jamb, the would-be thief or invader does not have the leverage to pry open the door, and, consequently, is prevented from break into the building through the locked door.

Advantageously, the door plate protects the locking mechanism of the door and militates against forceful entry into the building.

Further areas of applicability will become apparent from the description provided herein. It should be understood that the description and specific examples are intended for purposes of illustration only and are not intended to limit the scope of the present disclosure.

DRAWINGS

The above, as well as other advantages of the present disclosure, will become readily apparent to those skilled in the art from the following detailed description, particularly when considered in the light of the drawings described herein.

DETAILED DESCRIPTION

The following detailed description and appended drawings describe and illustrate various embodiments of the invention. The description and drawings serve to enable one skilled in the art to make and use the invention and are not intended to limit the scope of the invention in any manner. In respect of the methods disclosed, the order of the steps presented is exemplary in nature, and thus, is not necessary or critical unless otherwise disclosed.

As used herein, the term "door plate" may include a door plate that can used for exterior doors. However, it should be appreciated that other uses for the door plate are contemplated and may therefore be included within the scope of this disclosure.

Figure 1:
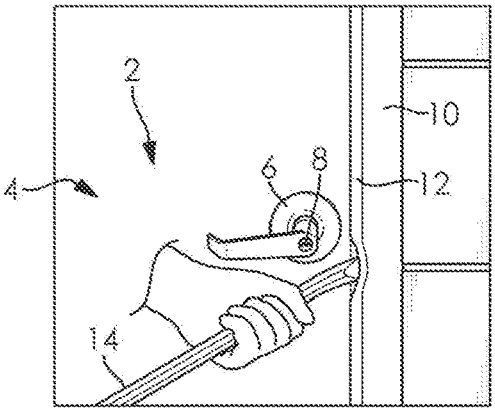
FIG. 1 (PRIOR ART)
FIG. 1 is a front perspective view of a door disposed in a door frame, according to the prior art, and further showing a crowbar disposed between the door and a lock jamb of the door frame.

With reference to FIG. 1, a door 2 is shown. The door 2 is configured to permit ingress and egress through a doorway 4 of an enclosure, such as a residential or commercial building. In some instances, the door 2 is configured to swing outwardly. In other instances, the door 2 is configured to swing inwardly. It should be appreciated the door plate 100 may be utilized with other types of doors 2, such as sliding doors, within the scope of this disclosure.

The door 2 has a door handle 6 and a locking mechanism 8. The door 2 may be hingedly connected to a door frame 10. The door frame 10 includes a vertical member, known as a lock jamb 12, that cooperates with the locking mechanism 8. For example, the lock jamb 12 may include a striker plate that receives a bolt from the locking mechanism 8, which in turn holds and secures the door 2 in a closed position. Undesirably, the locking mechanisms 8 may be bypassed by an intruder prying the door 2 open using a crowbar 14, as shown in FIG. 1. Specifically, a burglar may be able to dispose the crowbar 14 between the door 2 and the lock jamb 12 and pry the door off the door frame 10 to gain entry to the enclosure or building.

Now referencing FIGS. 2-20, the door plate 100 is configured to be disposed on the door 2 and militate a forceful entry into the doorway 4. In particular, the door plate 100 is configured to militate against the door 2 being pried open by the intruder disposing the crowbar 14 between the door 2 and the lock jamb 12, as shown in FIG. 17.

Referring back to FIGS. 2-20, the door plate 100 has a main body 102. The main body 102 has a front side 104, a rear side 106, a top side 108, a bottom side 110, a first adjacent side 112, and a second adjacent side 114.

In particular examples, the main body 102 may be manufactured from aluminum. However, it should be appreciated that one skilled in the art may manufacture the main body 102 from other durable materials, such as steel.

Figure 4:
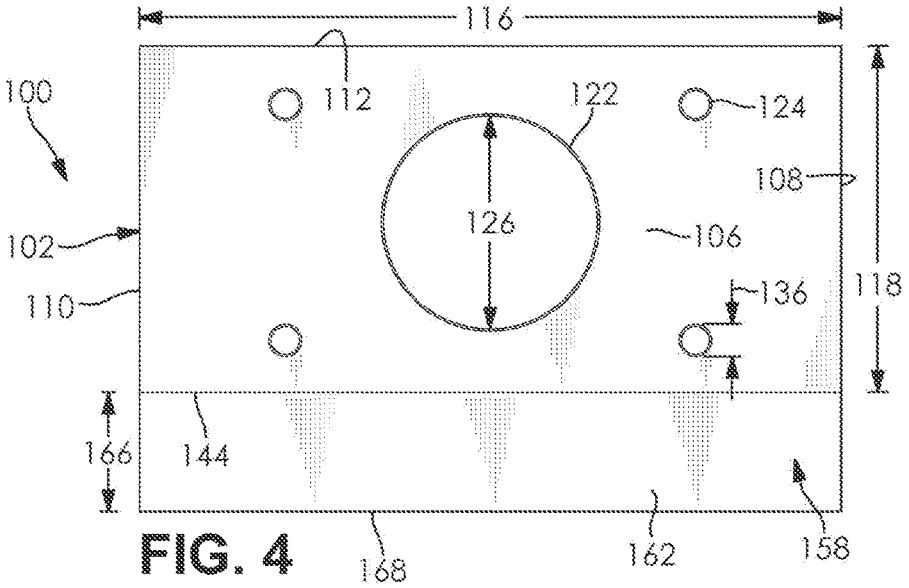
FIG. 4 is a front elevational view of the door plate shown in FIG. 1, and further showing a plurality of fastener apertures and a handle aperture.
Figure 5:
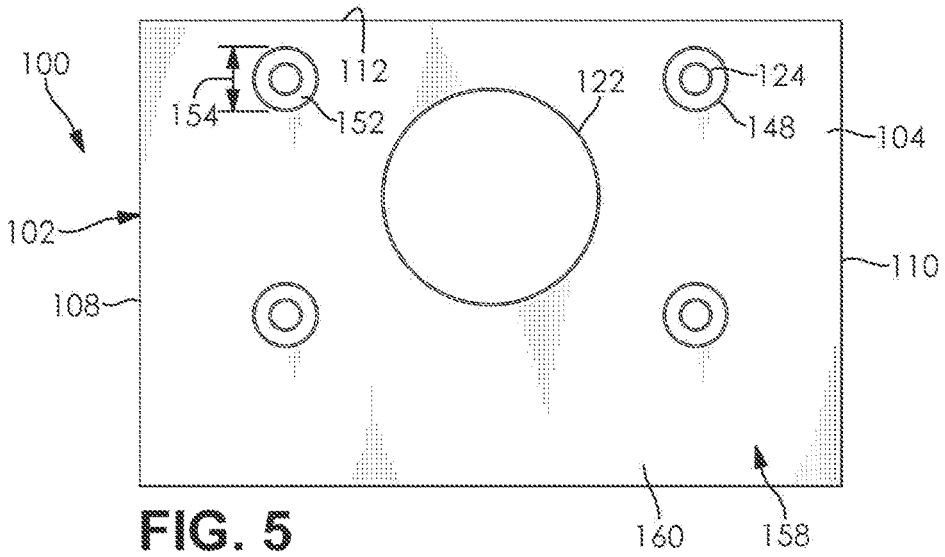
FIG. 5 is a rear elevational view of the door plate shown in FIG. 1, and further showing each of the plurality of fastener apertures disposed in one of a plurality of recesses.
Figure 7:
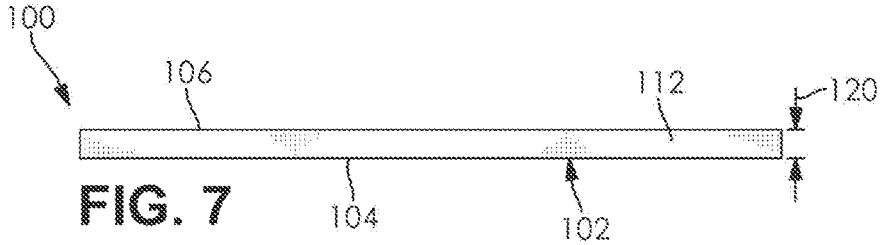
FIG. 7 is a left side elevational view of the door plate shown in FIG. 1, and further showing a first adjacent side of the door plate.
Figure 8:
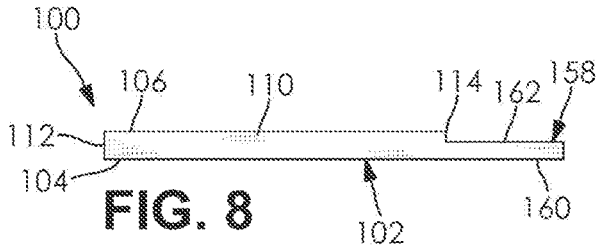
FIG. 8 is a bottom plan view of the door plate shown in FIG. 1, and further showing a bottom side of the door plate.
Figure 9:
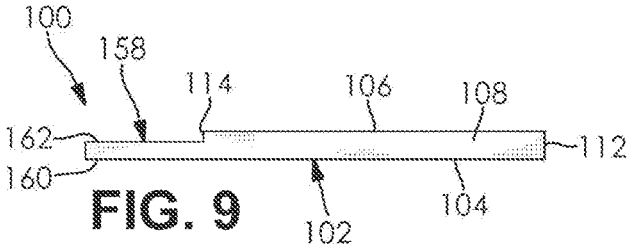
FIG. 9 is a top plan view of the door plate shown in FIG. 1, and further showing a top side of the door plate.
Figure 10:
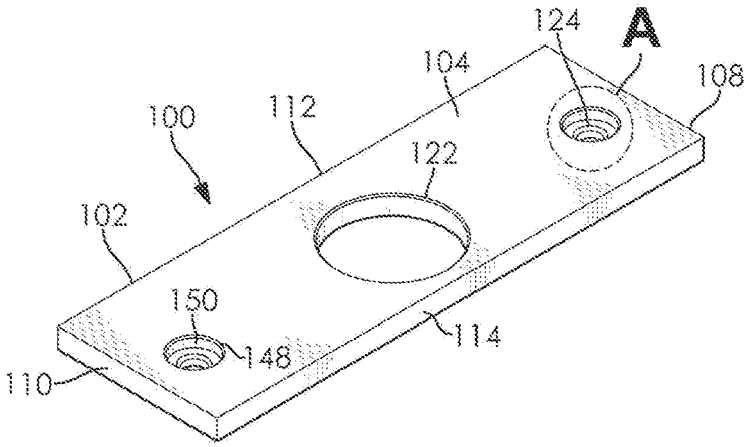
FIG. 10 is a front perspective view of a door plate, according to one embodiment of the disclosure, and further showing each of the plurality of fastener apertures disposed in one of the plurality of recesses.
Figure 11:
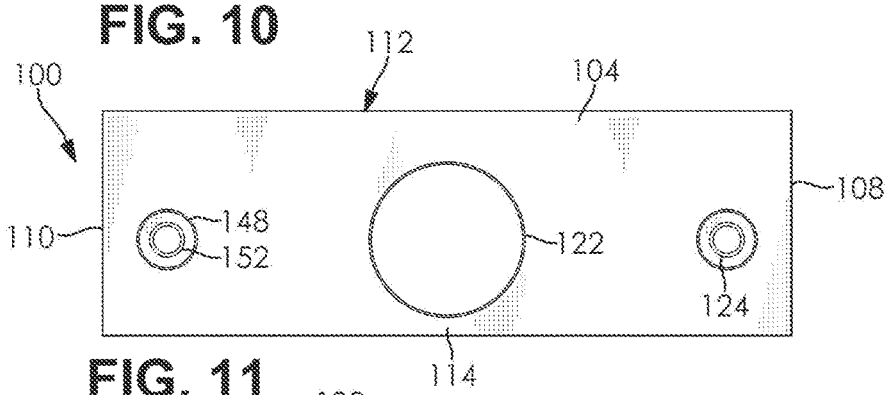
FIG. 11 is a front elevational view of the door plate shown in FIG. 10, and further showing a front side of the door plate.
Figure 12:
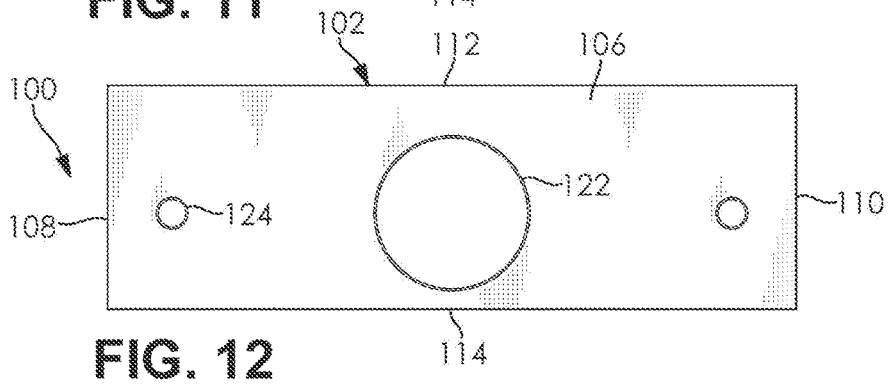
FIG. 12 is a rear elevational view of the door plate shown in FIG. 10, and further showing the plurality of fastener apertures on the rear side of the door plate.
Figure 13:
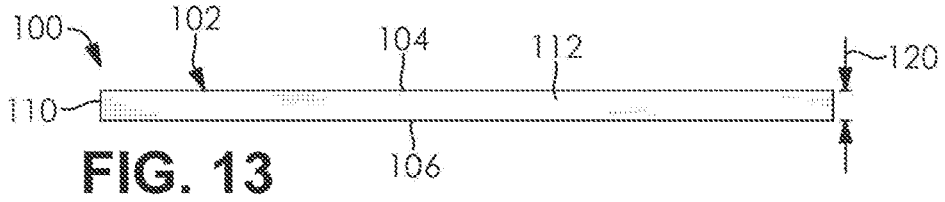
FIG. 13 is a left side elevational view of the door plate shown in FIG. 10, and further showing the first adjacent side of the door plate.
Figure 14:
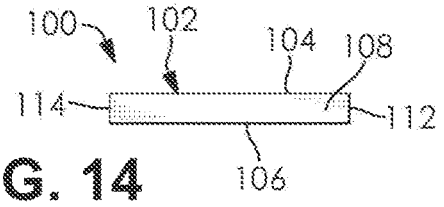
FIG. 14 is a top plan view of the door plate shown in FIG. 10, and further showing the top side of the door plate.

The main body 102 also has a body length 116, a body width 118, and a body depth 120. The body length 116 is defined by a maximum distance between the top side 108 and the bottom side 110 of the main body 102, as shown in FIG. 4. While still referring to FIG. 4, the body width 118 is defined by a maximum distance between the first adjacent side 112 and the second adjacent side 114. As shown in FIG. 7, the body depth 120 is defined by a maximum distance between the front side 104 and the rear side 106 of the main body 102 at the second adjacent side 114 of the main body 102. The second adjacent side 114 of the main body 102 is the side configured to be placed adjacent the door frame 10 in operation, as described further herein.

In specific examples, the body length 116 may be at least twelve inches (12"). The body width 118 may be at least about four and one-half inches (4.575"). The body depth 120 may be at least three-eighths of an inch (0.375"). In more specific examples, the body length 116 may be at least sixteen inches (16"). The body width 118 may be at least eight inches (8").

A skilled artisan will appreciate that the body depth 120 of the present disclosure has been found to be particularly advantageous and important to the operation of the door plate 100 of the disclosure. Without being bound to any particular theory, it is believed that, regardless of the material selected, the thickness or body depth 120 of the door plate 100 is instrumental in militating against a breaking and entering with the crowbar because the would-be intruder is prevented from inserting or obtaining sufficient leverage with the crowbar relative to the door 2 and door frame 10. In particular, it has been found that the body depth 120 being be at least three-eighths of an inch (0.375") can serve this purpose. More particularly, the body depth 120 may be at least one-half inches (0.50"). In even more specific examples, the body depth 120 may be at least 0.63". Although these dimensions have been shown to useful, a skilled artisan may select other dimensions for the main body 102, within the scope of this disclosure.

In operation, and as shown in FIG. 17, the second adjacent side 114 of the door plate 100 is disposed on the door 2 and adjacent to the lock jamb 12. This placement gives an additional thickness to the door 2 in the area adjacent to the lock jamb 12. Desirably, this added thickness militates against the crowbar 14 from being able to provide the intruder leverage between the door 2 and the lock jamb 12, also shown in FIG. 17.

In addition, this additional thickness adjacent the lock jamb 12 may also militate against a burglar circumventing the locking mechanism 8 of the door 2 by simply prying the door 2 open. It is believed that this placement is particularly useful for doors 2 that swing inwardly.

Figure 18:
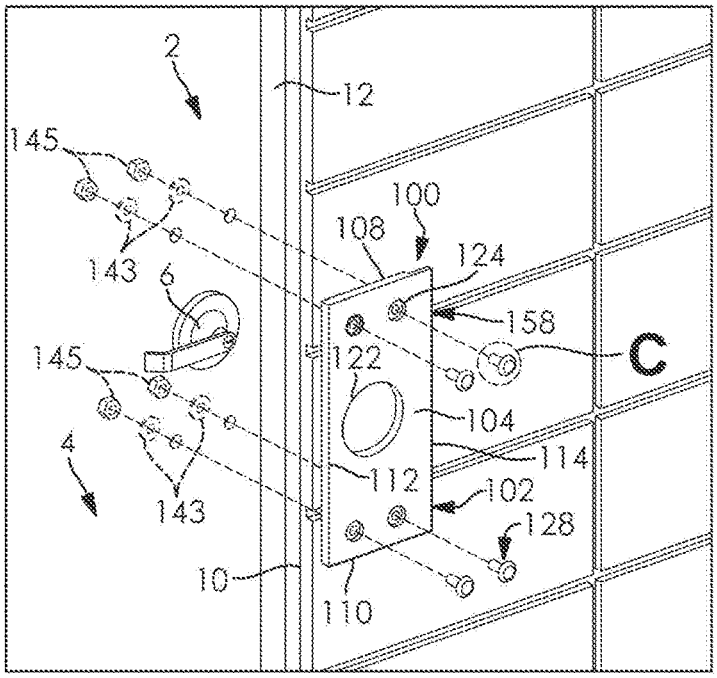
FIG. 18 is an exploded view of the door plate disposed on the door shown in FIG. 17, and further showing a plurality of fasteners.
Figure 20:
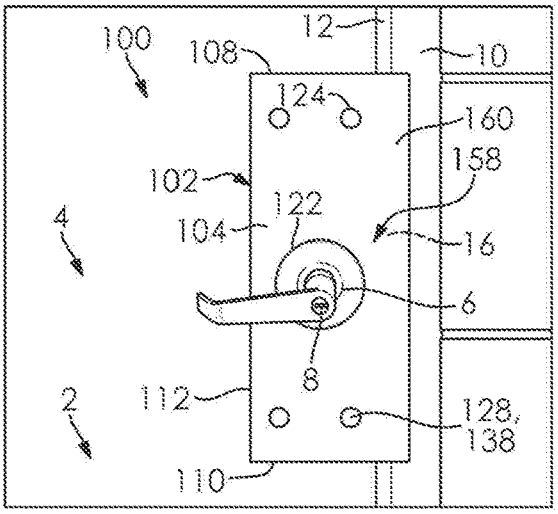
FIG. 20 is a front perspective view of the door plate shown in FIG. 1 disposed on the door, and further showing the overhang disposed over a portion of the lock jamb of the door frame.

Now referring to FIG. 18 and FIG. 20, the door plate 100 may further include a handle aperture 122 and a plurality of fastener apertures 124. The handle aperture 122 is configured to receive the door handle 6 of the door 2. The handle aperture 122 is formed through the main body 102 from the front side 104 and the rear side 106 of the main body 102.

In some embodiments, the handle aperture 122 conforms to the door handle 6, thereby providing a flush fitting of the handle aperture 122 with the door handle 6. Desirably, this may militate against the burglar from prying the door plate 100 off the door 2 by militating against the crowbar 14 from being able to gain leverage between the handle aperture 122 and the door handle 6.

In specific examples, the handle aperture 122 has a handle aperture diameter 126, as shown in FIG. 4. The handle aperture diameter 126 may be at least about two-and-one-quarter inches (2.25"). In more specific examples, the handle aperture diameter 126 may be at least about three-and-six-tenths inches (3.625"). However, it should be appreciated that one skilled in the art may select a different size for the handle aperture diameter 126 of the handle aperture 122 in order to accommodate different sizes of door handles 6.

Figure 15:
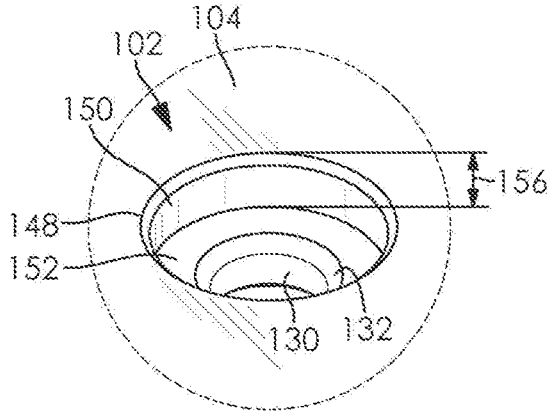
FIG. 15 is an enlarged view of one of the plurality of recesses taken at call-out A in FIG. 10, and further showing a front chamfer edge of one of the plurality of apertures.
Figure 16:
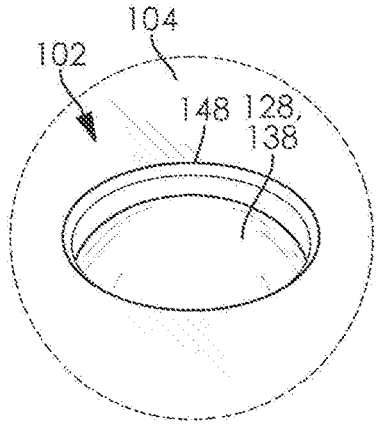
FIG. 16 is an enlarged view of one of the plurality of recesses taken at call-out B in FIG. 17, and further showing a flush fitting of a truss head of a fastener with one of the plurality of recesses.
Figure 17B:
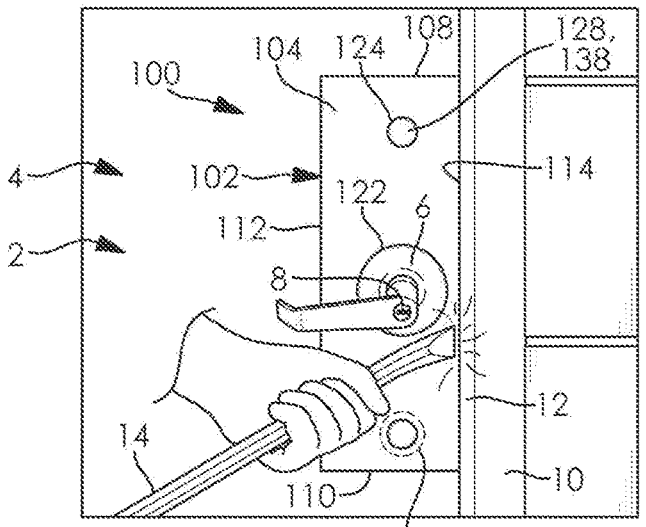
FIG. 17 is a front perspective view of the door plate shown in FIG. 10 disposed on the door, and further showing the crowbar not being able to gain leverage between the door plate and the door.

As shown particularly in FIGS. 16 and 18, each of the plurality of fastener apertures 124 is configured to receive a fastener 128. The plurality of fastener apertures 124 are formed through the main body 102 from the front side 104 and the rear side 106 of the main body 102. With reference to FIG. 15, each of the plurality of fastener apertures 124 may have an inner wall 130, a front chamfer edge 132 and a rear chamfer edge 134. As shown in FIG. 15, the front chamfer edge 132 is formed on the front side 104 of the main body 102.

Figure 2:
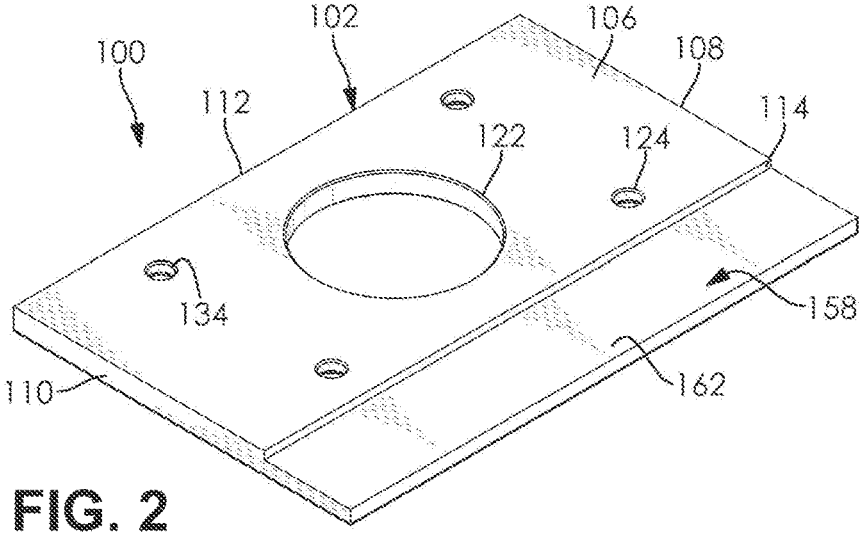
FIG. 2 is a rear perspective view of a door plate, according to one embodiment of the disclosure, and further showing a rear side of the door plate with an overhang.

Now referring to FIG. 2, the rear chamfer edge 134 is formed on the rear side 106 of the main body 102. Desirably, the plurality of fastener apertures 124 permit the door plate 100 to be secured to the door 2. It should be appreciated that a person skilled in the art may scale the number of the plurality of fastener apertures 124, as desired.

With reference to FIG. 4, each of the plurality of fastener apertures 124 has a fastener aperture diameter 136. The fastener aperture 136 may be smaller than the handle aperture diameter 126. In specific examples, the fastener aperture diameter 136 may be 0.50 inches. In more specific examples, the fastener aperture diameter 136 may be 0.53 inches. Although these dimensions have been shown to useful, other dimensions may be selected by a skilled artisan, within the scope of this disclosure.

Figure 19:
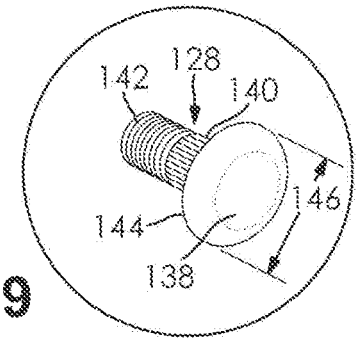
FIG. 19 is an enlarged view of one of the plurality of fasteners shown in FIG. 18 taken at call-out C in FIG. 18.

Now referencing, FIG. 19, the fastener 128 may be a knurled bolt 128 with truss head 138, a knurled portion 140, and a shaft 142. The truss head 138 is configured to engage with the front side 104 of the main body 102, thereby holding the knurled bolt 128 in position.

The truss head 138 has an outer edge 144 and a truss head diameter 146. The truss head 138 is disposed on the knurled portion 140. It should be appreciated that one skilled in the art may select other bolt heads for the truss head 138, as desired.

During installation, the knurled portion 140 is configured to contact and dig into or otherwise deform against the inner wall 130 of one of the plurality of fastener apertures 124. Desirably, the knurled portion 140 digs into the inner wall 130, or otherwise deforms tightly against the inner wall 130, which militates against the knurled bolt 128 from falling out of one of the plurality of fastener apertures 124.

In some instances, the front chamfer edge 132 of each of the plurality of fastener apertures 124 facilitates the sliding on the knurled portion 140 into contacting the inner wall 130 of one of the plurality fastener apertures 124. The knurled portion 140 is disposed between the truss head 138 and the shaft 142. It should be appreciated that a person skilled in the art may select different textures and shapes for the knurled portion 140 in order to secure the knurled bolt 128 to the main body 102.

The shaft 142 of the knurled bolt 128 is configured to be disposed through one of the plurality of fastener apertures 124 and the door 2. The door plate 100 may further include a plurality of washers 143 and a plurality of nuts 145. Each of the plurality of washers 143 and each of the plurality of nuts 145 are disposed on an end of the shaft 142 where the shaft 142 is disposed through the plurality fastener apertures 124 and the door 2, thereby affixing the door plate 100 to the door 2. It should be appreciated that a skilled artisan may affix the door plate 100 to the door 2 using other methods and fasteners 128, as desired.

With reference to FIGS. 3, 5, 10, 11, and 15-16, the main body 102 further includes a plurality of recesses 148. The plurality of recesses 148 are formed in the front side 104 of the door plate 100. As shown in FIG. 15, each of the plurality of recesses 148 has a recess inner wall 150, a base 152, a recess diameter 154, and recess depth 156. The recess depth 156 is defined as the maximum distance from the front side 104 of the main body 102 and the base 152 of one of the plurality or recesses 148, shown in FIG. 15. Each of the plurality of fastener apertures 124 is formed through the base 152 of one of the plurality of recesses 148 on the front side 104 of the main body 102.

In particular examples, the recess diameter 154 is greater than the fastener aperture diameter 136 and the truss head diameter 146. The truss head diameter 146 is greater than the fastener aperture diameter 136.

In specific examples, the recess diameter 154 is about one-and-one-eighth inches (1.125"). Although this size for the recess diameter 154 has shown to be useful, a skilled artisan may select another size for the recess diameter 154, as desired.

Now referring to FIGS. 16-18, and 20, the truss head 138 of the knurled bolt 128 is configured to be disposed in one of the plurality of recesses 148 and on the base 152 of one of the plurality of recesses 148. The outer edge 144 of the truss head 138 is configured to contact the recess inner wall 150 of one of the plurality of recesses 148, thereby providing a flush fitting of the truss head 138 with the recess inner wall 150, as shown in FIG. 16. Desirably, having this flush fitting militates against the burglar from being able to pry the knurled bolt 128 from the main body 102. Specifically, the flush fitting may make it more difficult for the crowbar 14 to be wedged between the truss head 138 and the recess inner wall 150 of one of the plurality of recesses 148.

With reference to FIGS. 2-9, 18, and 20, the main body 102 may further include an overhang 158 with a front overhang side 160 and a rear overhang side 162. The overhang 158 is configured to cover a portion 16 of the lock jamb 12, shown in FIG. 20. Desirably, the overhang 158 acts as a barrier and militates against the crowbar 14 from getting leverage via disposing the crowbar 14 between the door plate 100 and the door jamb 12. It is believed that the door plate 100 with the overhang 158 is particularly useful for doors 2 that swing outwardly. Although it should be appreciated that a skilled artisan may employ the door plate 100 with the overhang 158 on different types of doors 2. For example, a sliding door 2.

Figure 3:
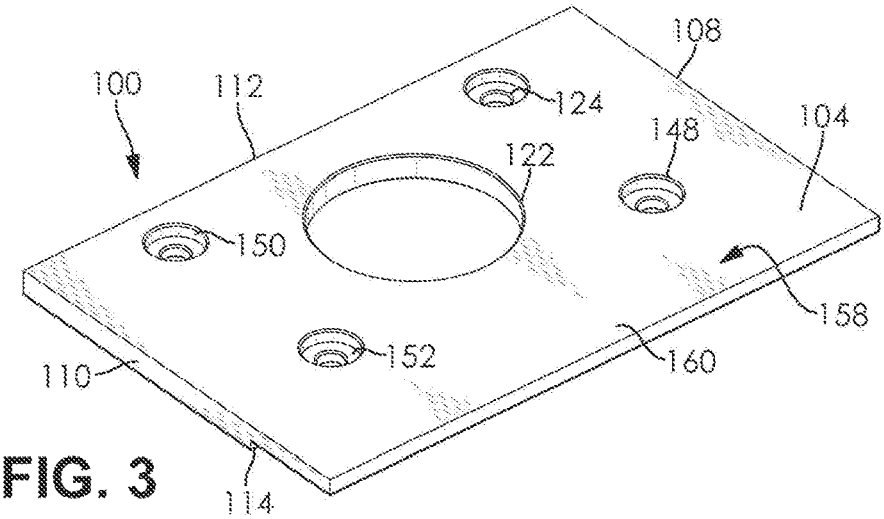
FIG. 3 is a front perspective view of the door plate shown in FIG. 1, and further showing a front side of the door plate.
Figure 6:
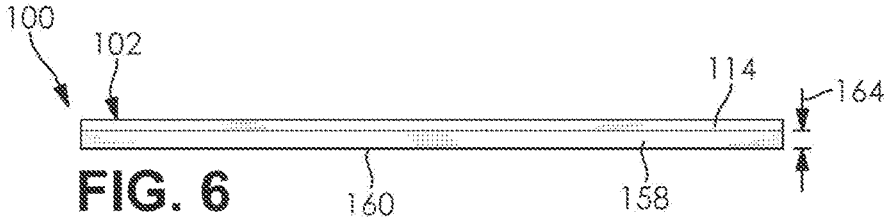
FIG. 6 is a right side elevational view of the door plate shown in FIG. 1, and further showing the door overhang and a second adjacent side of the door plate.

As shown particularly in FIGS. 2-3, the overhang 158 may be formed on the second adjacent side 114. The overhang 158 has an overhang depth 164 and an overhang length 166. With reference to FIG. 6, the overhang depth 164 is defined by a maximum distance between the front overhang side 160 and the rear overhang side 162 of the overhang 158. In some examples, the overhang depth 164 is less than the body depth 120. Desirably, this allows for the overhang 158 to be used on a lock jamb 12 that is not level with the door 2.

Now referring to FIG. 4, the overhang length 166 is defined by the distance from the second adjacent side 114 and an edge of the overhang 168. Desirably, the overhang length 166 is of a sufficient length that allows the overhang 158 to cover the portion 16 of the lock jamb 12.

In particular examples, the overhang depth 164 may be 0.38 inches and the overhang length 166 is two inches (2"). However, although these dimensions for the overhang 158 has shown to be useful, a person skilled in the art may select different dimensions, as desired.

It should be appreciated that the door plate 100 may be provided already installed on the door 2 or could be provided as a kit for installing the door plate 100 to the door 2. The kit may include the door plate 100, and a plurality of the fasteners 128, along with the plurality of the washers 143 and the plurality of nuts 145. Advantageously, the kit may provide the consumer with means for retrofitting an existing door 2 of a building in order to enhance security of the same.

Figure 21:
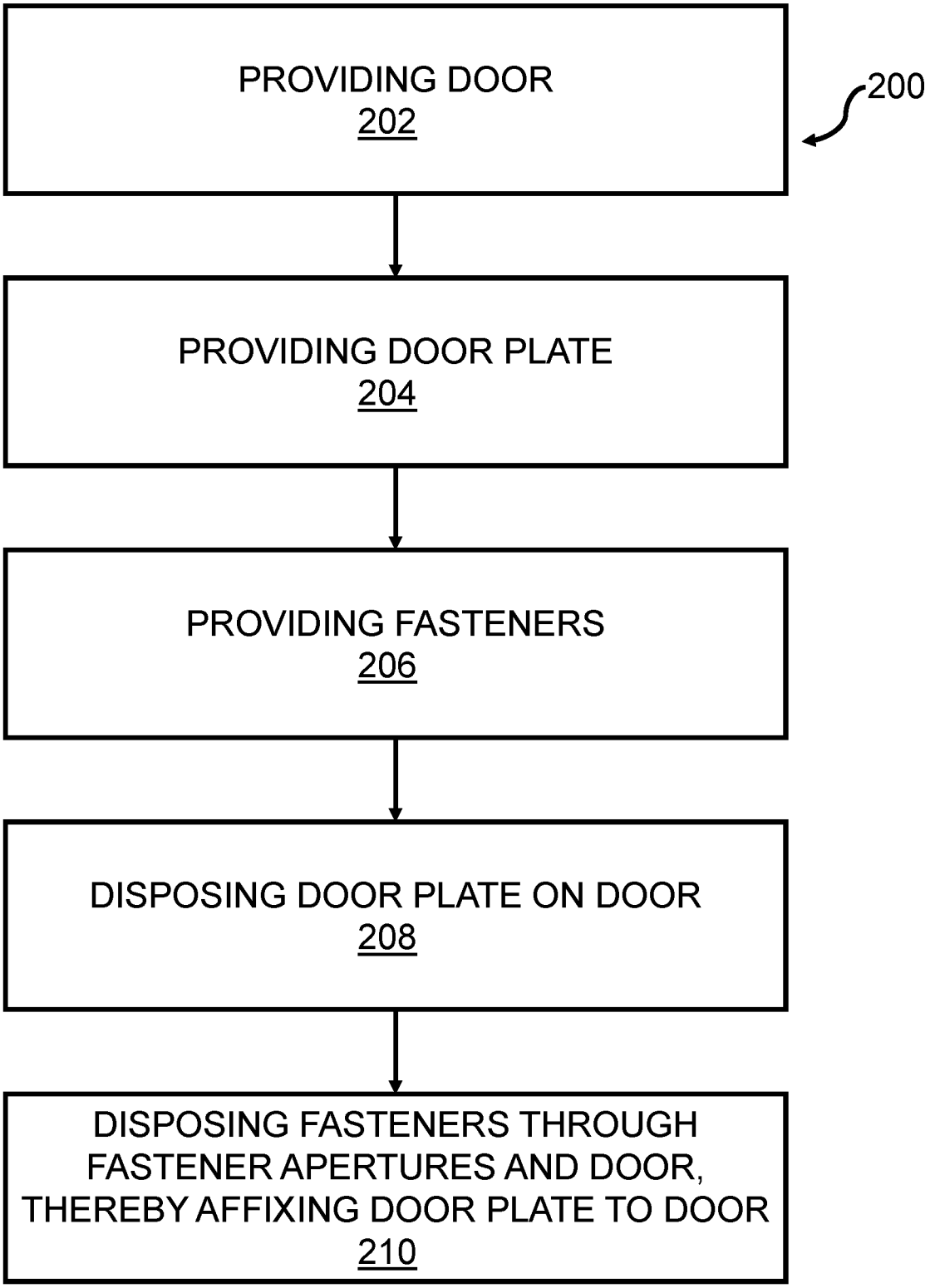
FIG. 21 is a flowchart showing a method for installing the door plate onto the door, according to one embodiment of the disclosure.

With reference to FIG. 21, a method 200 for installing the door plate 100 is shown. The method 200 includes a step of 202 of providing the door 2 with the door handle 6. Next, a step 204 of providing the door plate 100. Then, a step 206 of providing the plurality of fasteners 128. The plurality of fasteners 128 may include the plurality of washers 143 and the plurality of nuts 145.

Next, the door plate 100 is disposed on the door 2, in a step 208. The handle aperture 122 surrounds the door handle 6. Then, in a step 210 each fastener 128 is disposed through one of the plurality of fastener apertures 124. Each of the plurality of washers 143 and each of the plurality of nuts 145 are disposed on the end of the shaft 142 and torqued, thereby affixing the door plate 100 to the door 2.

Where the door 2 is an inwardly swinging door 2, the step 210 includes disposing the door plate 100 so that the second adjacent side 114 of the main body 102 of the door plate 100 is adjacent to the lock jamb 12 of the door frame 10, as shown in FIG. 17.

Where the door 2 is an outwardly swinging door 2 and the main body 102 has the overhang 158, the step 210 includes disposing the door plate 100 so that the overhang 158 is covering the portion 16 of the lock jamb 12, as shown in FIG. 20.

Advantageously, the door plate 100 and method 200 militates against a forceful entry. The body depth 120 of the main body 102 militates against a prying of the door 2 with the crowbar 14 where the main body 102 is installed on the door 2.

While certain representative embodiments and details have been shown for purposes of illustrating the invention, it will be apparent to those skilled in the art that various changes may be made without departing from the scope of the disclosure, which is further described in the following appended claims.

What is claimed is:

1. A door plate for a door, comprising:

a main body with a front side, a rear side, a top side, a bottom side, a first adjacent side, a second adjacent side, the main body having a handle aperture and a plurality of fastener apertures each having a front chamfer edge, the front chamfer edge is formed on the front side of the main body, the handle aperture configured to receive a door handle of the door, the handle aperture having a handle aperture diameter and each of the plurality of fastener apertures has a fastener aperture diameter, and the handle aperture diameter is greater than the fastener aperture diameter, and the handle aperture formed through the main body from the front side to the rear side of the main body, each of the plurality of fastener apertures formed through the base of one of the plurality of recesses on the front side of the main body and configured to receive a fastener, each of the plurality of fastener apertures formed through the main body from the front side to the rear side, the first adjacent side of the main body is configured to not be disposed adjacent to a lock jamb of a door frame and the second adjacent side of the main body is configured to be adjacent to the lock jamb of the door frame, wherein the main body has a depth that is at least 0.375 inches, and the depth is defined by a maximum distance between the front side and the rear side of the main body at the second adjacent side of the main body, whereby the depth of the main body militates against a prying of the door with a crowbar where the main body is installed on the door and the main body further includes a plurality of recesses formed in the front side of the main body, and each of the plurality of recesses has an inner wall and a base, and each of the plurality of recesses having a recess diameter and a recess depth, wherein the recess diameter is greater than the fastener aperture diameter, and the main body further includes an overhang with a front side and a rear side formed on the second adjacent side of the main body, the overhang is configured to cover a portion of a lock jamb of a door frame, and the overhang has an overhang depth defined by a maximum distance between the front side and the rear side of the overhang.

2. The door plate of claim 1, wherein the overhang depth is less than the depth of the main body.

3. The door plate of claim 2, wherein the depth of the main body is at least 0.50 inches.

4. The door plate of claim 3, wherein the depth of the main body is at least 0.63 inches.

5. A door protection system, comprising:

a door having a door handle;

a door plate having a main body with a front side, a rear side, a top side, a bottom side, a first adjacent side, a second adjacent side, the main body having a handle aperture and a plurality of fastener apertures each having a front chamfer edge, the front chamfer edge is formed on the front side of the main body, the handle aperture surrounds the door handle of the door, the handle aperture having a handle aperture diameter and each of the plurality of fastener apertures has a fastener aperture diameter, and the handle aperture diameter is greater the fastener aperture diameter and the handle aperture formed through the main body from the front side to the rear side of the main body, each of the plurality of fastener apertures formed through base of one of the plurality of recesses on the front side of the main body from the front side to the rear side, and the first adjacent side of the main body is configured to not be disposed adjacent to a lock jamb of a door frame and the second adjacent side of the main body is configured to be adjacent to the lock jamb of the door frame, wherein the main body has a depth that is at least 0.375 inches, and the depth is defined by a maximum distance between the front side and the rear side of the main body at the second adjacent side of the main body, whereby the depth of the main body militates against a prying of the door with a crowbar where the main body is installed on the door and the main body further includes a plurality of recesses formed in the front side of the main body, and each of the plurality of recesses has an inner wall and a base, and each of the plurality of recesses having a recess diameter and a recess depth, wherein the recess diameter is greater than the fastener aperture diameter, and the main body further includes an overhang with a front side and a rear side formed on the second adjacent side of the main body, the overhang is configured to cover a portion of a lock jamb of a door frame, and the overhang has an overhang depth defined by a maximum distance between the front side and the rear side of the overhang; and a plurality of fasteners, each of the plurality of fasteners disposed through one of the plurality of fastener apertures and the door, thereby affixing the door plate to the door.

6. A method for installing a door plate, the method comprising the steps of:

providing an outwardly swinging door with a door handle;

providing a door plate having a main body with a front side, a rear side, a top side, a bottom side, a first adjacent side, a second adjacent side, and an overhang formed on the second adjacent side of the main body, the main body having a handle aperture and a plurality of fastener apertures, the handle aperture configured to receive the door handle of the door, the handle aperture formed through the main body from the front side to the rear side of the main body, each of the plurality of fastener apertures formed through the main body from the front side to the rear side, wherein the main body has a depth that is at least 0.375 inches, and the depth is defined by a maximum distance between the front side and the rear side of the main body at the second adjacent side of the main body, whereby the depth of the main body militates against a prying of the door with a crowbar where the main body is installed on the door;

providing a plurality of fasteners;

disposing the door plate on the door, the handle aperture surrounding the door handle of the door;

disposing the second adjacent side of the main body of the door plate adjacent to a lock jamb of a door frame, whereby the overhang covers a portion of the lock jamb of the door frame; and disposing each of the plurality of fasteners through one of the plurality of fastener apertures and the door, thereby securing the door plate to the door.

* * * * *